US012767397B2

(12) United States Patent
Tsuzuki et al.

(10) Patent No.: US 12,767,397 B2
(45) Date of Patent: Oct. 20, 2026

(54) CLOSURE STRUCTURE AND CONTAINER WITH CLOSURE STRUCTURE

(71) Applicant: CSI JAPAN CO., LTD., Minato-ku (JP)

(72) Inventors: Mitsuo Tsuzuki, Minato-ku (JP); Takashi Tsuchiya, Minato-ku (JP); Tadayuki Seshimo, Minato-ku (JP)

(73) Assignee: CSI JAPAN CO., LTD., Tokyo (JP)

( * ) Notice: Subject to any disclaimer, the term of this patent is extended or adjusted under 35 U.S.C. 154(b) by 1 day.

(21) Appl. No.: 18/911,518

(22) Filed: Oct. 10, 2024

(65) Prior Publication Data

US 2025/0115397 A1 Apr. 10, 2025

(30) Foreign Application Priority Data

Oct. 10, 2023 (JP) ..... 2023-175165

(51) Int. Cl.
*B65D 47/12* (2006.01)
*B65D 41/34* (2006.01)

(52) U.S. Cl.
CPC ..... *B65D 47/123* (2013.01); *B65D 41/3447* (2013.01); *B65D 2251/023* (2013.01); *B65D 2401/15* (2020.05)

(58) Field of Classification Search
CPC ..... B65D 47/123; B65D 41/3447; B65D 2251/023; B65D 2401/15
See application file for complete search history.

(56) References Cited

U.S. PATENT DOCUMENTS

| | | | | |
|---|---|---|---|---|
| 5,810,184 | A * | 9/1998 | Adams | B65D 5/746 215/45 |
| 8,231,020 | B2 * | 7/2012 | Taber | B65D 41/04 215/305 |
| 10,265,897 | B2 * | 4/2019 | Gehringer | B65D 41/0485 |
| 2015/0129534 | A1 * | 5/2015 | Falzoni | B65D 41/0421 215/316 |

* cited by examiner

*Primary Examiner* — James N Smalley
(74) *Attorney, Agent, or Firm* — NIXON PEABODY LLP

(57) ABSTRACT

A closure structure includes a cap, and a spout having a mouth portion to which the cap is attached. The cap includes a top plate portion and a tube portion. The tube portion extends downward from a periphery of the top plate portion. The tube portion is divided into a main portion and a tamper evidence ring portion. The tamper evidence ring portion is connected to the main portion by a bridge. An inner-circumferential surface of the main portion is formed with a threaded portion. An outer-circumferential surface of the main portion is formed with an upper knurl and a side knurl. The upper knurl is formed at a position including an upper end of the outer-circumferential surface. The side knurl is formed at a position lower than the upper knurl.

14 Claims, 5 Drawing Sheets

CLOSURE STRUCTURE AND CONTAINER WITH CLOSURE STRUCTURE

CROSS-REFERENCE TO RELATED APPLICATION

This application is based upon and claims the benefit of priority from Japanese Patent Application No. 2023-175165 filed on Oct. 10, 2023, which is hereby incorporated by reference in its entirety.

BACKGROUND OF THE INVENTION

Field of the Invention

The present invention relates to a closure structure and a container with a closure structure.

Description of the Related Art

Closure structures have been used in which some include a cap and a spout. The cap is attached to the spout. A closure structure is attached to a container. A knurl portion is formed on an outer-circumferential surface of a cap (see, for example, Japanese Unexamined Patent Application, First Publication No. 2015-217966). The knurl portion has an antislip function when a user holds and rotates the cap.

It is necessary to suppress the height of the closure structure (that is, reduction in height) depending on the container serving as an attachment object. Since the height of the cap of the closure structure is low, the surface area of the outer-circumferential surface that can be held by the user is small. Therefore, it may become difficult to grip and rotate the cap.

An object of one aspect of the invention is to provide a closure structure and a container with the closure structure that cause an opening operation of the cap to be easy.

SUMMARY OF THE INVENTION

One aspect of the invention provides a closure structure including a cap and a spout having a mouth portion to which the cap is attached. The cap includes a top plate portion and a tube portion. The tube portion extends downward from a periphery of the top plate portion. The tube portion is divided into a main portion and a tamper evidence ring portion. The tamper evidence ring portion is connected to the main portion by a bridge. An inner-circumferential surface of the main portion is formed with a threaded portion. An outer-circumferential surface of the main portion is formed with an upper knurl and a side knurl. The upper knurl is formed at a position including an upper end of the outer-circumferential surface. The side knurl is formed at a position lower than the upper knurl.

In one embodiment, the outer-circumferential surface of the main portion has a smooth annular lower region. The lower region is formed at a position lower than the side knurl.

In another embodiment, the outer-circumferential surface of the main portion has an annular recessed portion. The annular recessed portion is formed at a position including the upper end of the outer-circumferential surface. The annular recessed portion extends in the circumferential direction of the main portion. The upper knurl includes a plurality of upper knurl projection portions. The upper knurl projection portions protrude from an inner surface of the annular recessed portion.

In a further embodiment, each of the upper knurl projection portions is formed in a plate shape perpendicular to the circumferential direction.

Another aspect of the invention provides a container with a closure structure including the closure structure described above and a container to which the closure structure is attached.

According to one aspect of the invention, the closure structure and the container with the closure structure can be provided that cause an opening operation of the cap to be easy.

The above summary is not intended to represent each embodiment or every aspect of the present invention. Additional features and benefits of the present invention are apparent from the detailed description and figures set forth below.

Figure 1:
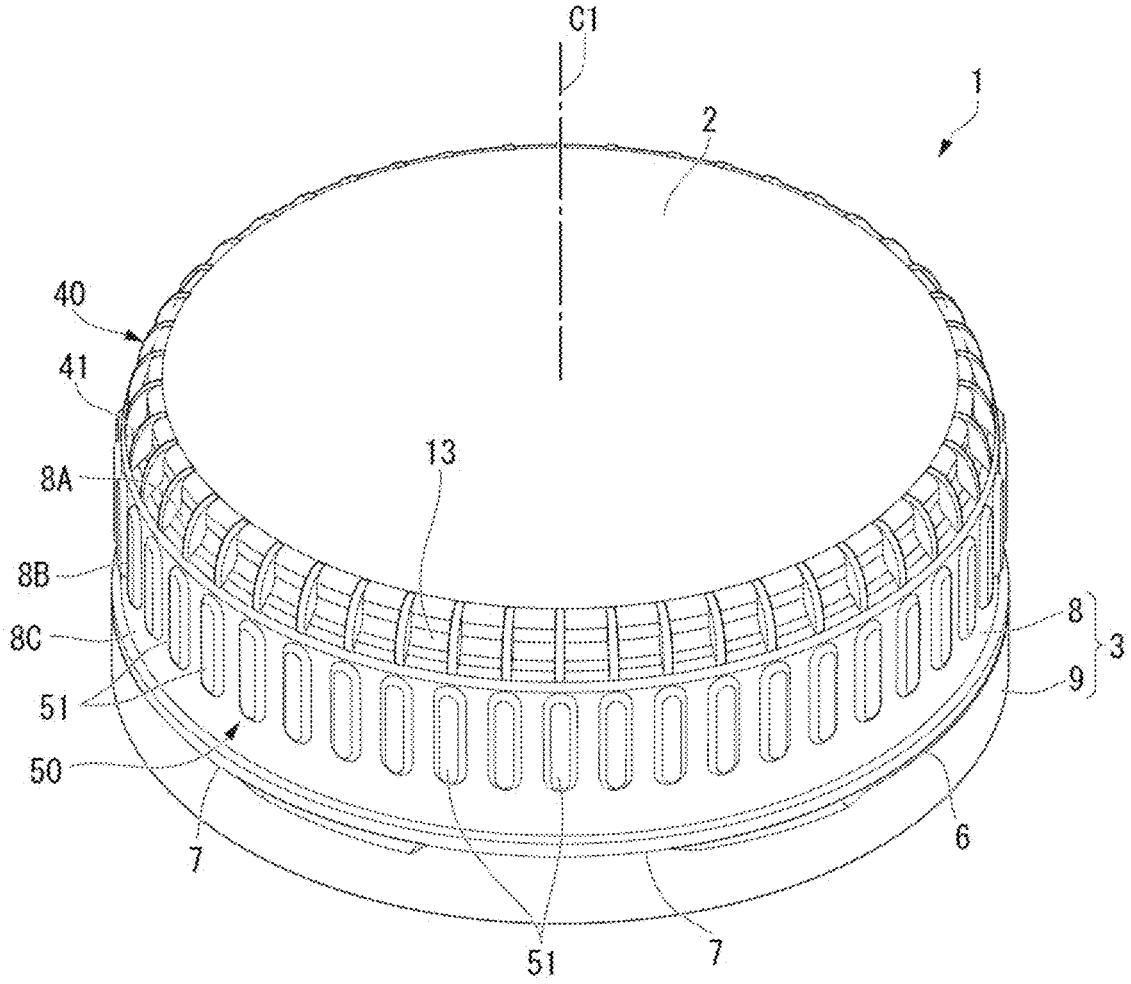
FIG. 1 is a perspective view showing a cap of a closure structure according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

[Closure Structure]

Figure 2:
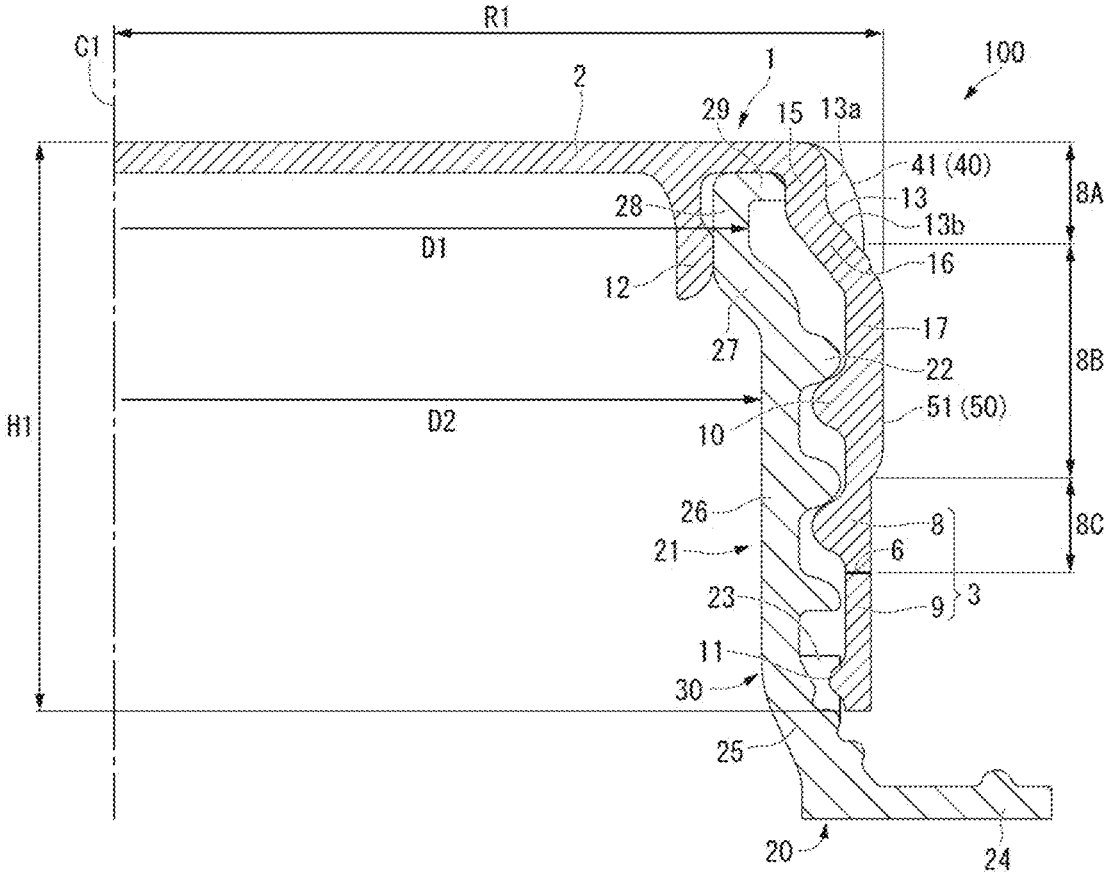
FIG. 2 is a partial cross-sectional view showing the closure structure of FIG. 1.
Figure 3:
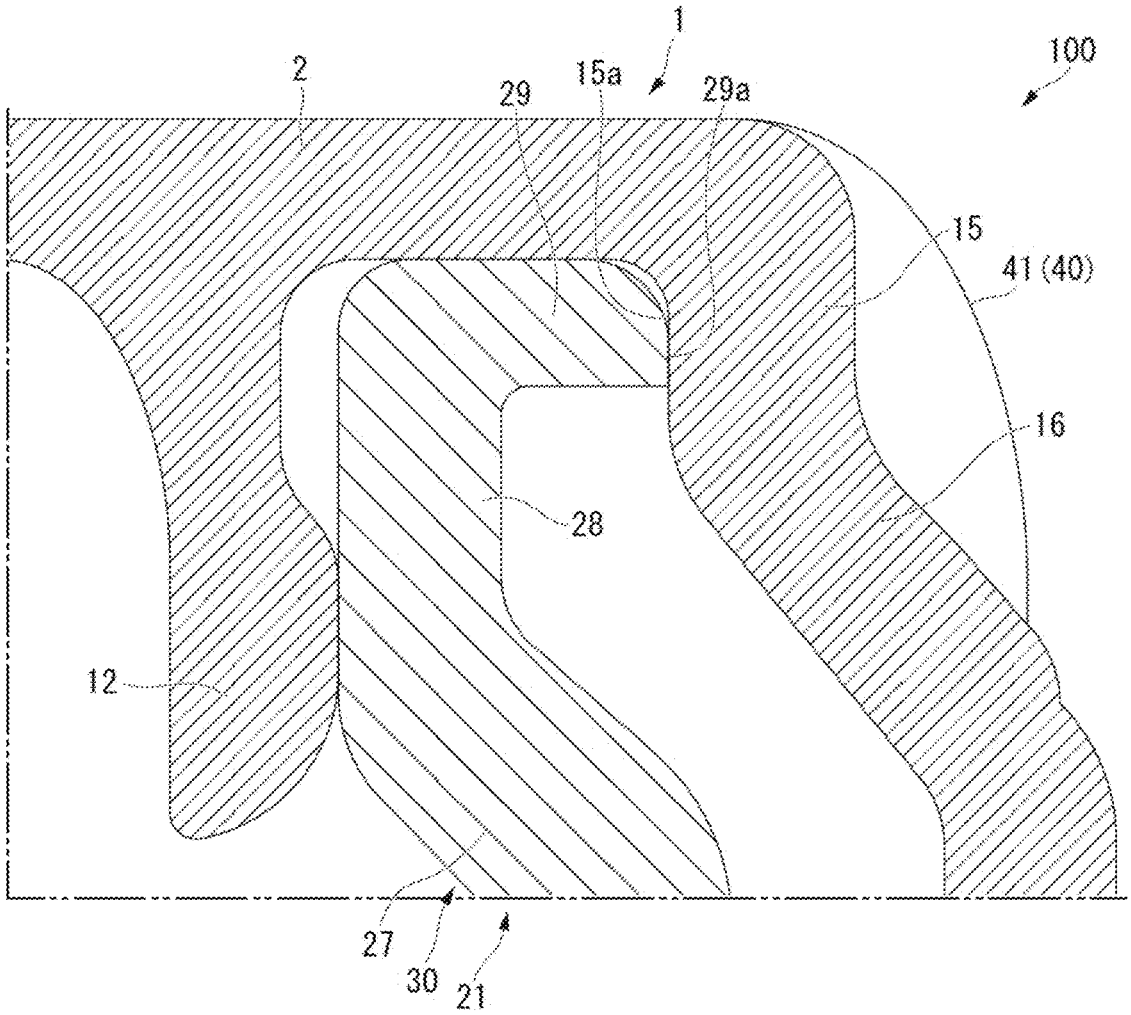
FIG. 3 is an enlarged partial cross-sectional view showing the closure structure of FIG. 1.
Figure 4:
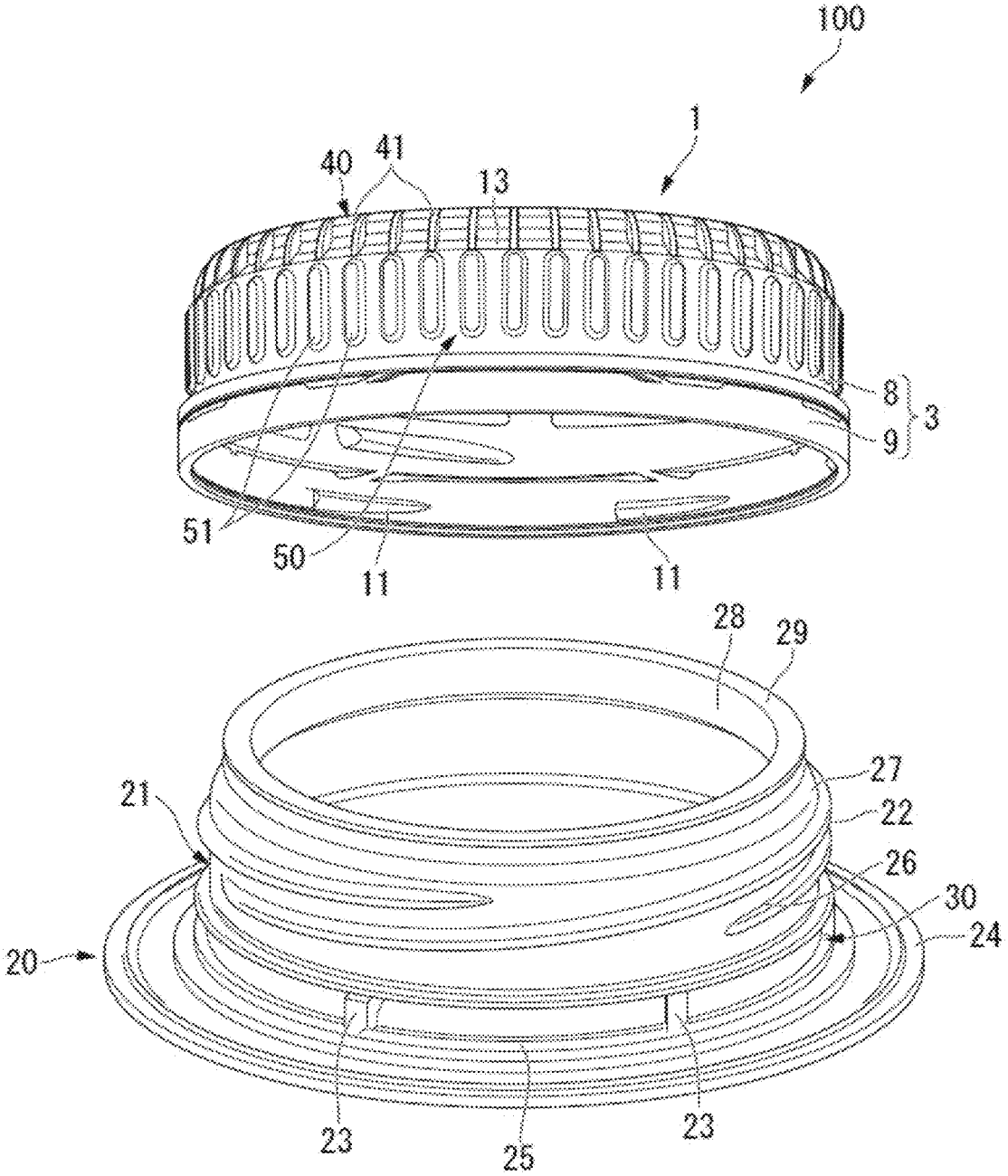
FIG. 4 is an exploded perspective view showing the closure structure of FIG. 1.

FIG. 1 is a perspective view showing a cap 1 of a closure structure 100 according to an embodiment. FIG. 2 is a partial cross-sectional view showing the closure structure 100. FIG. 3 is a partial cross-sectional view showing the closure structure 100. FIG. 4 is an exploded perspective view showing the closure structure 100.

In the following description, the vertical positional relationship of the closure structure 100 is provisionally defined based on FIG. 2. A central axis C1 is the central axis of the cap 1 and the mouth portion 21. A vertical direction is the direction along the central axis C1. The vertical direction is also referred to as a "height direction". The direction around the central axis C1 is referred to as a "circumferential direction". The direction perpendicular to the central axis C1 is referred to as a "radial direction". The positional relationship defined here does not limit the posture of the closure structure 100 in use.

Referring to FIG. 2, the closure structure 100 includes a cap 1 and a spout 20. The spout 20 includes a mouth portion 21 and a base plate portion 24. The base plate portion 24 extends radially outward from the lower end of the mouth portion 21. The base plate portion 24 is formed in an annular shape. The base plate portion 24 is formed in a plate shape perpendicular to the central axis C1.

The mouth portion 21 includes a tubular portion 30 and a flange portion 29. The tubular portion 30 includes a first diameter-reducing portion 25, a main tube portion 26, a second diameter-reducing portion 27 (diameter-reducing portion), and an upward-extension portion 28. The tubular portion 30 is formed in a substantially cylindrical shape. The tubular portion 30 is formed so as to project substantially upward from the inner circumferential edge of the base plate portion 24.

The first diameter-reducing portion 25 is formed in a cylindrical shape that rises from the inner circumferential edge of the base plate portion 24 while reducing in diameter. The main tube portion 26 is formed in a cylindrical shape that extends upward from the upper end of the first diameter-reducing portion 25. The second diameter-reducing portion 27 is formed in a cylindrical shape that rises from the upper end of the main tube portion 26 while reducing in diameter.

The upward-extension portion 28 is formed in a cylindrical shape that extends upward from the upper end of the second diameter-reducing portion 27. The upward-extension portion 28 is located at a higher position than the main tube portion 26. The outer diameter D1 of the upward-extension portion 28 is desirably equal to or smaller than the inner diameter D2 of the main tube portion 26 (more specifically, the inner diameter of the main tube portion 26 in the height range where the male thread 22 is formed). In other words, the outer diameter D1 of the upward-extension portion 28 is desirably the same as or smaller than the inner diameter D2 of the main tube portion 26. The outer diameter D1 of the upward-extension portion 28, which is equal to or smaller than the inner diameter D2 of the main tube portion 26, can increase the rigidity of the mouth portion 21. The outer diameter D1 of the upward-extension portion 28 is equal to the outer diameter of the upper end of the first diameter-reducing portion 25 (the smallest outer diameter of the first diameter-reducing portion 25).

The flange portion 29 extends radially outward from the upper end of the tubular portion 30 (more specifically, the upper end of the upward-extension portion 28). The flange portion 29 is formed in an annular shape. The flange portion 29 is in a plate shape perpendicular to the central axis C1. An upper surface of the flange portion 29 is in contact with the inner surface (lower surface) of the top plate portion 2. The outer-circumferential surface 29*a* of the flange portion 29 is in contact with an inner-circumferential surface 15*a* of the downward-extension portion 15 (see FIG. 3). In this embodiment, the outer-circumferential surface 29*a* of the flange portion 29 is in contact with a downward-extension portion 15, and the upper surface of the flange portion 29 is in contact with the inner surface (lower surface) of the top plate portion 2. However, in another embodiment, the upper surface of the flange portion 29 does not have to be in contact with the inner surface of the top plate portion 2 as long as the outer-circumferential surface 29*a* is in contact with the downward-extension portion 15.

The outer diameter of the flange portion 29 (outer diameter when the cap 1 is not attached) is desirably larger than the inner diameter of the downward-extension portion 15 of the cap 1 (inner diameter when the cap 1 is not attached to the mouth portion 21). Therefore, in a state in which the flange portion 29 is fitted inside the downward-extension portion 15, at least one of the flange portion 29 and the downward-extension portion 15 is in contact with each other in an elastically deformed state. The flange portion 29 is elastically deformed with the diameter reduced. The downward-extension portion 15 is elastically deformed with the diameter increased. Therefore, the flange portion 29 and the downward-extension portion 15 come into contact with each other under the action of an elastic force in a direction in which they approach each other. Either the flange portion 29 or the downward-extension portion 15 may deform, or both may deform. This can bring closer contact between the outer-circumferential surface 29*a* of the flange portion 29 and the inner-circumferential surface 15*a* of the downward-extension portion 15, thereby improving the sealing performance of the closure structure 100.

The outer-circumferential surface of the main tube portion 26 is formed with a male thread 22. The male thread 22 projects radially outward from the outer-circumferential surface of the main tube portion 26. The male thread 22 is screwed into the threaded portion 10 of the cap 1.

An outer-circumferential surface of the first diameter-reducing portion 25 is formed with a plurality of locking projection portions 23. The locking projection portions 23 are block-shaped projections that project radially outward from the outer-circumferential surface of the upper part of the first diameter-reducing portion 25. The locking projection portions 23 is formed at a position lower than the male thread 22. The plurality of locking projection portions 23 is formed at intervals in the circumferential direction. At least some of the locking projection portions 23 are at a height position that allows them to be locked with the locking projections 11 of the cap 1.

The bending rigidity of the tubular portion 30 is, for example, lower than the bending rigidity of the tube portion 3 of the cap 1. The bending rigidity can be evaluated, for example, by a three-point bending test in accordance with JIS K7171:2016.

The spout 20 comprises a synthetic resin in one embodiment. Some non-limiting examples of synthetic resins include polyethylene or polypropylene. One non-limiting example of polyethylene is a low-density polyethylene. The use of low-density polyethylene makes it easier to heat-fuse the spout 20 to the container 200. It is contemplated that other polyethylenes may be used in forming the spout. It is also contemplated that other synthetic resins may be used in forming the spout.

The cap 1 includes a top plate portion 2 and a tube portion 3. The top plate portion 2 is circular. The top plate portion 2 is perpendicular to the central axis C1. The inner surface (lower surface) of the top plate portion 2 is formed with an inner seal projection 12. The inner seal projection 12 projects downward from the inner surface (lower surface) of the top plate portion 2. The inner seal projection 12 is formed in an annular or cylindrical shape. The inner seal projection 12 fits into the mouth portion 21 and is in contact with the inner-circumferential surface of the mouth portion 21. More specifically, the inner seal projection 12 is in contact with the inner-circumferential surface of the upward-extension portion 28 or the second diameter-reducing portion 27.

The tube portion 3 extends downward from the periphery of the top plate portion 2. The tube portion 3 is formed in a cylindrical shape. The tube portion 3 is divided into a main portion 8 and a tamper evidence ring portion (TE ring portion) 9 by a score 6 (weakened portion). The TE ring portion 9 is connected to the lower end of the main portion 8 by a bridge 7.

An inner-circumferential surface of the TE ring portion 9 is formed with a plurality of locking projections 11 (see FIG. 4). The locking projections 11 are locked in the locking projection portions 23 of the spout 20 in opening the cap to prevent the TE ring portion 9 from moving. The locking projections 11 each extend in the circumferential direction. The plurality of locking projections 11 is formed at intervals in the circumferential direction.

The main portion 8 includes a downward-extension portion 15, a diameter-increasing portion 16, and a main tube portion 17. The downward-extension portion 15 is formed in a cylindrical shape extending downward from the periphery of the top plate portion 2. The diameter-increasing portion 16 lowers from the lower end of the downward-extension portion 15 while increasing in diameter. The main tube portion 17 is formed in a cylindrical shape extending downward from the lower end of the diameter-increasing portion 16.

A threaded portion 10 is formed on the inner-circumferential surface of the main portion 8 (more specifically, the inner-circumferential surface of the main tube portion 17). The threaded portion 10 is screwed onto the male thread 22 of the spout 20.

The outer-circumferential surface of the main portion 8 has an upper region 8A, a middle region 8B, and a lower region 8C. The upper region 8A is an annular region that includes the upper end of the outer-circumferential surface of the main portion 8. The lower region 8C is an annular region that includes the lower end of the outer-circumferential surface of the main portion 8. The middle region 8B is an annular region that is interposed between the upper region 8A and the lower region 8C. The middle region 8B is located lower than the upper region 8A and higher than the lower region 8C. The upper region 8A, the middle region 8B, and the lower region 8C are annular regions that extend in the circumferential direction. The widths (height dimensions) of the upper region 8A, the middle region 8B, and the lower region 8C are constant in the circumferential direction.

The annular recessed portion 13 is formed at a position including the upper end of the outer-circumferential surface of the main portion 8. The annular recessed portion 13 is formed in annular shape in the circumferential direction. The annular recessed portion 13 is formed in the upper region 8A. The annular recessed portion 13 is a recessed portion formed because the outer diameters of the downward-extension portion 15 and the diameter-increasing portion 16 are smaller than the outer diameter of the main tube portion 17.

The inner surface of the annular recessed portion 13 has a first inner surface 13*a* and a second inner surface 13*b*. The first inner surface 13*a* has, for example, a curved convex shape as viewed in the circumferential direction. The first inner surface 13*a* is, for example, a curved convex surface having inclination angle with respect to the top plate portion 2 that increases as progress from the upper end of the main portion 8 as progress toward the diameter-increasing direction. The tangential direction at the lower end of the first inner surface 13*a* is substantially parallel to the vertical direction. The first inner surface 13*a* is the outer surface of the downward-extension portion 15.

The second inner surface 13*b* is, for example, linear as viewed in the circumferential direction. The second inner surface 13*b* is, for example, an inclined surface that lowers from the lower end of the first inner surface 13*a* while increasing in diameter. The lower end of the second inner surface 13*b* reaches the lower edge of the upper region 8A. The second inner surface 13*b* is the outer surface of the diameter-increasing portion 16.

As shown in FIGS. 1 and 2, the outer-circumferential surface of the main portion 8 is formed with an upper knurl 40 and a side knurl 50. The side knurl 50 is formed on the middle region 8B of the outer-circumferential surface of the main portion 8. The side knurl 50 has a plurality of side knurl projection portions 51. The side knurl projection portions 51 each project radially outward from the middle region 8B. The side knurl projection portions 51 are formed linearly in the vertical direction from the upper part to the lower part of the middle region 8B. The plurality of side knurl projection portions 51 is formed at intervals in the circumferential direction.

The projection height of each side knurl projection portion 51 (height from the middle region 8B) is 0.1 mm or more in one embodiment. In another embodiment, the projection height of each side knurl projection portion 51 (height from the middle region 8B) is 0.3 mm or more. The projection height of each side knurl projection portion 51 within the above range causes fingers to be likely to engage with the side knurl projection portions 51 in opening the bottle. The projection height of the side knurl projection portion 51 in one embodiment is 0.5 mm or less. The projection height of the side knurl projection portion 51 within the above range makes it possible to alleviate pain in the fingers in opening the bottle.

The width of each side knurl projection portion 51 is greater than 0.2 mm in one embodiment. In another embodiment, the width of each side knurl projection portion 51 is greater than 0.5 mm or more. In a further embodiment, the width of the side knurl projection portion 51 is from about 0.2 mm to about 1.5 mm, or from 0.5 mm to 1.5 mm. The pitch of the side knurl projection portions 51 is from 0.5 to 3 mm in one embodiment. The pitch of the side knurl projection portions 51 is from 0.5 to 3 mm and in another embodiment is from 1 to 3 mm. The pitch is the distance (circumferential distance) between the apexes of two adjacent side knurl projection portions 51. The pitch of the side knurl projection portions 51 within the above range causes fingers to be likely to engage with the side knurl projection portions 51 in opening the bottle, and makes it possible to alleviate pain in the fingers.

The upper end of each side knurl projection portions 51 is desirably located lower than the upper edge of the middle region 8B. The lower end of the side knurl projection portions 51 reaches the lower edge of the middle region 8B.

The side knurl 50 is formed at a lower position than the upper knurl 40. The upper knurl 40 is formed on the upper region 8A of the outer-circumferential surface of the main portion 8. The upper knurl 40 has a plurality of upper knurl projection portions 41. The upper knurl projection portions 41 project radially outward from the inner surface of the annular recessed portion 13. The upper knurl projection portions 41 are formed from the upper end to the lower end of the annular recessed portion 13. The plurality of upper knurl projection portions 41 is formed at intervals in the circumferential direction. Each upper knurl projection portion 41 is formed, for example, in a plate shape perpendicular to the circumferential direction.

As viewed in the circumferential direction, each upper knurl projection portion 41 has, for example, a curved convex shape projecting from the inner surface of the annular recessed portion 13. The outer edge of the upper knurl projection portion 41 curves, for example, such that the inclination angle with respect to the top plate portion 2 increases as progress from the upper end of the main portion 8 as progress toward the diameter-increasing direction. The tangential direction at the upper end of the outer edge of the upper knurl projection portion 41 is substantially parallel to the top plate portion 2. The tangential direction at the lower end of the outer edge of the upper knurl projection portion 41 is substantially parallel to the vertical direction.

The projection height of each upper knurl projection portion 41 (the maximum height from the inner surface of the annular recessed portion 13) is from 0.1 mm or more in one embodiment. In another embodiment, the projection height of each upper knurl projection portion 41 (the maximum height from the inner surface of the annular recessed portion 13) is from 0.3 mm or more. The projection height of the upper knurl projection portion 41 within the above range causes fingers to be likely to engage with the upper knurl projection portion 41 in opening the bottle. The projection height of the upper knurl projection portion 41 can be, for example, 0.8 mm or less. The projection height of the upper knurl projection portion 41 within the above range makes it possible to alleviate pain in the fingers in opening the bottle.

The width of the upper knurl projection portion 41 is from 0.1 mm or more in one embodiment. The width of the upper knurl projection portion 41 is from 1 mm or less in another embodiment. The pitch of the upper knurl projection portions 41 is from 0.5 to 3 mm in one embodiment. In another embodiment, the pitch of the upper knurl projection portions 41 is from 1 to 3 mm. The pitch is the distance (circumferential distance) between the apexes of two adjacent upper knurl projection portions 41. The pitch of the upper knurl projection portion 41 within the above range causes the fingers to be likely to engage with the upper knurl projection portions 41 in opening the bottle, and makes it possible to alleviate pain in the fingers.

It is desirable that the upper knurl 40 is located at a distance above the side knurl 50. The upper knurl 40 spaced apart from the side knurl 50 causes the user's fingers to be wedged between the upper knurl 40 and the side knurl 50 when the user grips the cap 1. This increases the engaging force at the lower end of the upper knurl projection portions 41 and the upper end of the side knurl projection portions 51.

It is desirable that the radial position of each upper knurl projection portion 41 coincide with the radial position of the side knurl projection portion 51. It is desirable that the number of upper knurl projection portions 41 be equal to the number of side knurl projection portions 51. It is desirable that the pitch of the upper knurl projection portions 41 be equal to the pitch of the side knurl projection portions 51.

The lower region 8C has no knurls formed in one embodiment. In one non-limiting example, the lower region 8C is formed smoothly without any unevenness.

The height H1 of the cap 1 can be, for example, equal to or less than the radius R1 of the cap 1 (half the outer diameter of the cap 1). This improves the storage capacity of a container with the closure structure (see FIG. 5).

The cap 1 comprises a synthetic resin in one embodiment. Some non-limiting examples of synthetic resins include polyethylene or polypropylene. One non-limiting example of polyethylene is a high-density polyethylene. It is contemplated that other polyethylenes may be used in forming the cap. It is also contemplated that other synthetic resins may be used informing the cap.

[Container with Closure Structure]

Figure 5:
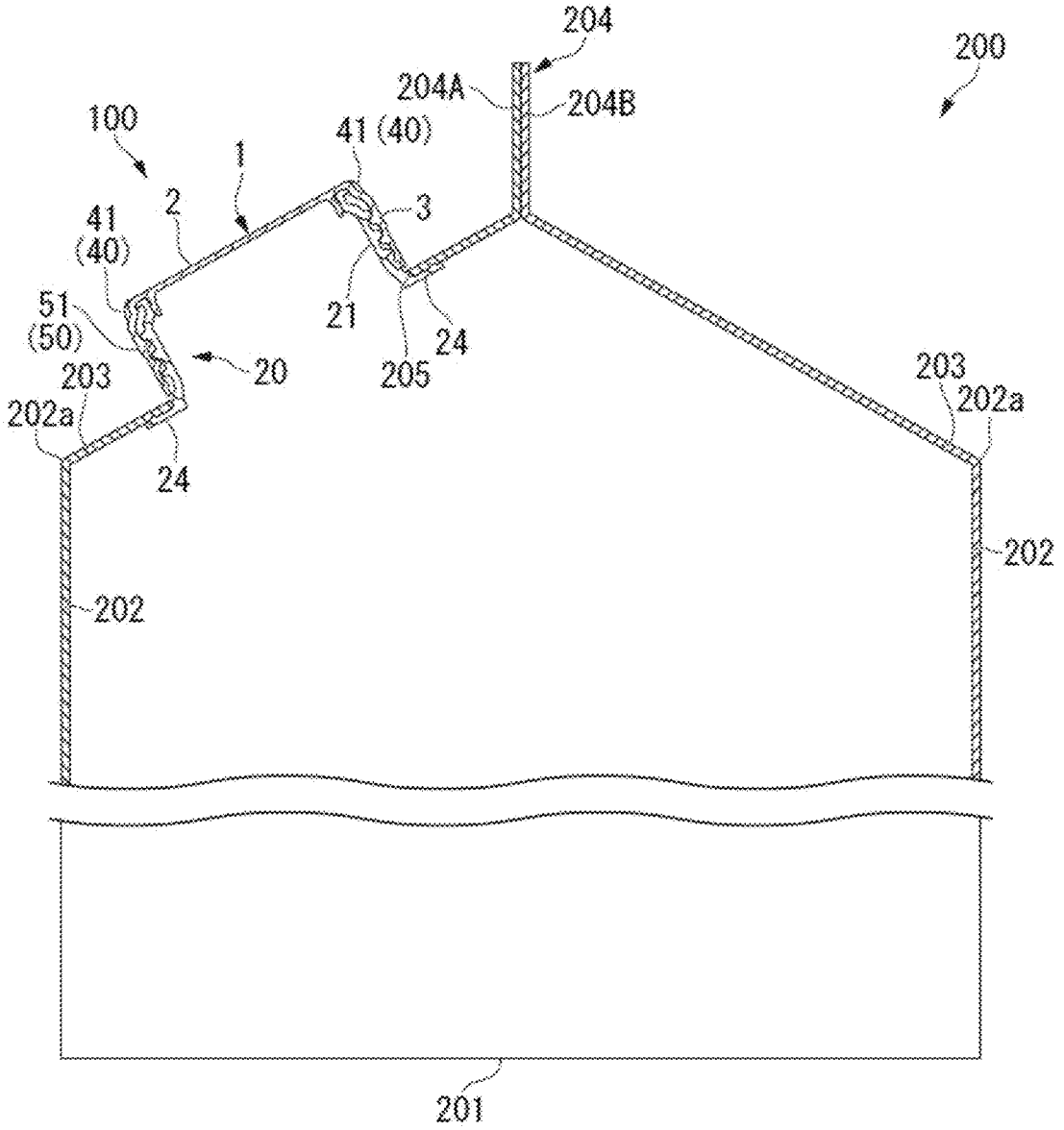
FIG. 5 is a cross-sectional view showing a container of FIG. 1 according to one embodiment to which the closure structure is attached.

FIG. 5 is a cross-sectional view showing a container 200 to which the closure structure 100 is attached (container with the closure structure).

As shown in FIG. 5, the container 200 includes a bottom portion 201, a body portion 202, a pair of upper plate portions 203, and a joint portion 204. The bottom portion 201 is formed in a rectangular shape. The body portion 202 is formed in a rectangular tubular shape. The body portion 202 extends upward from the periphery of the bottom portion 201. Each upper plate portion 203 extends upward at an angle from the upper end of the body portion 202. More specifically, the upper plate portions 203 extends upward from two opposing edges 202*a* of the upper end of the body portion 202 in a direction approaching each other.

The joint portion 204 is formed by stacking a first extension portion 204A and a second extension portion 204B and joining them to each other by fusion or the like. The first extension portion 204A extends upward from the upper end of one upper plate portion 203. The second extension portion 204B extends upward from the upper end of the other upper plate portion 203.

The container 200 is formed, for example, by a laminate sheet including a base material and a resin layer. The base material in one embodiment comprises paper, resin, etc. The resin layer comprises low-density polyethylene in one embodiment. The resin layer is the innermost layer facing the internal space of the container 200. A container having base material comprising paper is a paper pack container. The laminate sheet may be provided with a metal layer comprising an aluminum alloy or the like between the base material and the resin layer.

One of the pair of upper plate portions 203 is formed with an insertion hole 205. The mouth portion 21 of the spout 20 is inserted into the insertion hole 205. The upper surface of the base plate portion 24 is placed on the inner surface of the upper plate portion 203. The upper surface of the base plate portion 24 is in contact with the inner surface of the upper plate portion 203. The base plate portion 24 is attached to the inner surface of the upper plate portion 203 by heat fusion or the like. More specifically, the base plate portion 24 is heat-fused to the resin layer provided on the inner surface of the upper plate portion 203. The base plate portion 24 is joined to the upper plate portion 203 in a liquid-tight manner.

The cap 1 is low in height. Therefore, as viewed from above the container 200, the cap 1 does not protrude outward from the side surface of the container 200. Therefore, a plurality of containers with the closure structures can be stored side by side with no gaps. The cap 1 is located lower than the upper end of the joint portion 204. Therefore, a plurality of containers with the closure structures can save space even when stacked vertically.

The containers with the closure structures can store beverages such as fruit juice, tea, coffee, dairy drinks, and milk.

[Method of Using the Closure Structure]

The following describes a method of opening the cap 1 of the closure structure 100.

A user grips the cap 1. The user's fingers come into contact with the outer-circumferential surface of the cap 1. More specifically, the user's fingers come into contact with the side knurl 50 and the upper knurl 40, and engage with the side knurl projection portions 51 and the upper knurl projection portions 41.

When the user rotates the cap 1 in the opening direction, the main portion 8 rotates, while the locking projections 11 are locked in the locking projection portions 23. Therefore, the TE ring portion 9 is prevented from rotating. A tensile force acts on the bridge 7 connecting the main portion 8 and the TE ring portion 9. The bridge 7 breaks due to this tensile force, and the TE ring portion 9 is separated from the main portion 8. This clearly indicates that the cap 1 has been opened.

As the main portion 8 rises, the inner seal projection 12 is pulled out of the mouth portion 21, and the seal is released.

[Effects that Closure Structure of the Embodiment Exhibits]

In the closure structure 100, not only the side knurl 50 but also the upper knurl 40 are formed on the outer-circumferential surface of the main portion 8 of the cap 1. When the user grips the cap 1, the user's fingers engage with the side knurl 50 and the upper knurl 40, enhancing the anti-slip effect. This makes it easier to open the cap 1.

The outer-circumferential surface of the main portion 8 is formed with a smooth lower region 8C at a position lower than the side knurl 50. When the user grips the cap 1, the user's fingers are wedged into the lower region 8C, increasing the engaging force at the lower end of the side knurl projection portions 51.

In the closure structure 100, an annular recessed portion 13 is formed on the upper region 8A of the main portion 8. The upper knurl projection portions 41 of the upper knurl 40 are formed to project from the inner surface of the annular recessed portion 13. This makes it possible to reduce the projection dimension of the upper knurl projection portions 41 without reducing the engaging force. This allows the cap 1 to be made smaller.

The upper knurl projection portions 41 of the upper knurl 40 are each formed in a plate shape perpendicular to the circumferential direction. This increases the engaging force when the user grips the cap 1.

In the closure structure 100, the mouth portion 21 of the spout 20 has a tubular portion 30 and a flange portion 29. The outer-circumferential surface 29*a* of the flange portion 29 is in contact with the inner-circumferential surface of the main portion 8 of the cap 1. Since the outer-circumferential surface 29*a* of the flange portion 29 is the main sealing surface, the contact area of the sealing surface can be reduced. Therefore, the opening torque of the cap 1 can be reduced. Therefore, ease of opening the cap 1 can be increased.

In the closure structure 100, since the outer-circumferential surface 29*a*, which has a small area, is the sealing surface, the pressing force from the flange portion 29 acts outward in a concentrated manner. This makes it possible to bring closer contact between the outer-circumferential surface 29*a* of the flange portion 29 and the inner-circumferential surface of the main portion 8. This increases the sealing performance of the closure structure 100.

The tubular portion 30 of the spout 20 includes a main tube portion 26 and an upward-extension portion 28. The outer diameter D1 of the upward-extension portion 28 is equal to or smaller than the inner diameter D2 of the main tube portion 26. The upward-extension portion 28 is made thinner, such that the rigidity of the mouth portion 21 can be increased. Therefore, even if the spout 20 is made of a material that is lower in strength than the cap 1 (e.g., low-density polyethylene), the spout 20 can be given sufficient strength.

It is desirable that the bending rigidity of the tubular portion 30 of the spout 20 be lower than the bending rigidity of the tube portion 3 of the cap 1. This causes the tubular portion 30 to be likely to deform to bend radially inward. The radially inward deformation of the tubular portion 30 makes closer contact force between the upward-extension portion 28 and the inner seal projection 12. This increases the sealing performance of the closure structure 100.

As for the specific configuration of the closure structure, the configurations given in the above embodiment can be selected or changed to other configurations as appropriate without departing from the gist of the invention.

The cross-sectional shape of each side knurl projection portion (shape of a cross section perpendicular to the central axis of the cap) is not particularly limited. The cross-sectional shape of the side knurl projection portion can be, for example, an arc shape or a polygonal shape (for example, a triangular shape, a rectangular shape).

The shape of each upper knurl projection portion is not particularly limited. For example, the shape of the upper knurl projection portion as viewed in the circumferential direction is not limited to a curved convex shape, but may be a polygonal shape (for example, a triangular shape, a rectangular shape). The cross-sectional shape of the upper knurl projection portion (shape of a cross section perpendicular to the central axis of the cap) may be, for example, an arc shape or a polygonal shape (for example, a triangular shape, a rectangular shape).

The lower region of the main portion just needs absence of a knurl portion. The lower region is not limited to a cylindrical surface, and may be a flat surface or a shape that combines a plurality of flat surfaces.

In the embodiment of the closure structure 100, the tubular portion 30 of the spout 20 has a first diameter-reducing portion 25, a main tube portion 26, a second diameter-reducing portion 27, and an upward-extension portion 28, but a configuration is also possible that has no upward-extension portion 28. In this case, the tubular portion has a first diameter-reducing portion, a main tube portion, and a second diameter-reducing portion. The flange portion extends radially outward from the upper end of the second diameter-reducing portion.

The cap according to the embodiment includes the following configuration. The cap includes a top plate portion and a tube portion. The tube portion extends downward from a periphery of the top plate portion. The tube portion is divided into a main portion and a tamper evidence ring portion. The tamper evidence ring portion is connected to the main portion by a bridge. An inner-circumferential surface of the main portion is formed with a threaded portion. An outer-circumferential surface of the main portion is formed with an upper knurl and a side knurl. The upper knurl is formed at a position including an upper end of the outer-circumferential surface. The side knurl is formed at a position lower than the upper knurl.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention.

What is claimed is:

1. A container with a closure structure, comprising:

the closure structure including a cap and a spout, the cap including a top plate portion and a tube portion, the tube portion extending downward from a periphery of the top plate portion, the tube portion being divided into a main portion and a tamper evidence ring portion, the tamper evidence ring portion being connected to the main portion by a bridge, the main portion including an inner-circumferential surface and an outer-circumferential surface, the inner-circumferential surface of the main portion being formed with a threaded portion, the outer-circumferential surface of the main portion being formed with an upper knurl and a side knurl, the upper knurl being formed at a position including an upper end of the outer-circumferential surface, the upper knurl including a plurality of upper knurl projection portions, the side knurl being formed at a position lower than the upper knurl, the spout having a mouth portion to which the cap is attached; and a container to which the closure structure is attached, wherein each respective outer edge of the upper knurl projection portions has an inclination angle with respect to the top plate portion that progressively increases downwardly from an upper end of the main portion, a tangential direction at each upper end of the respective outer edges of the upper knurl projection portions being substantially parallel to the top plate portion, a tangential direction at each lower end of the respective outer edges of the upper knurl projection portions being substantially parallel to the main portion, wherein the outer-circumferential surface of the main portion has a smooth annular lower region, the smooth annular lower region being formed at a position lower than the side knurl, wherein the outer-circumferential surface of the main portion has an annular recessed portion, the annular recessed portion being formed at a position including the upper end of the outer-circumferential surface, the annular recessed portion extending in the circumferential direction of the main portion, the upper knurl projection portions protruding from an inner surface of the annular recessed portion.

2. The container with closure structure of claim 1, wherein each of the upper knurl projection portions is formed in a plate shape perpendicular to the circumferential direction.

3. A closure structure, comprising:

a cap including a top plate portion and a tube portion, the tube portion extending downward from a periphery of the top plate portion, the tube portion being divided into a main portion and a tamper evidence ring portion, the tamper evidence ring portion being connected to the main portion by a bridge, the main portion including an inner-circumferential surface and an outer- circumferential surface, the inner-circumferential surface of the main portion being formed with a threaded portion, the outer-circumferential surface of the main portion being formed with an upper knurl and a side knurl, the upper knurl being formed at a position including an upper end of the outer-circumferential surface, the upper knurl including a plurality of upper knurl projection portions, the side knurl being formed at a position lower than the upper knurl; and a spout having a mouth portion to which the cap is attached, wherein each respective outer edge of the upper knurl projection portions has an inclination angle with respect to the top plate portion that progressively increases downwardly from an upper end of the main portion, a tangential direction at each upper end of the respective outer edges of the upper knurl projection portions being substantially parallel to the top plate portion, a tangential direction at each lower end of the respective outer edges of the upper knurl projection portions being substantially parallel to the main portion, wherein the outer-circumferential surface of the main portion has a smooth annular lower region, the smooth annular lower region being formed at a position lower than the side knurl, wherein the outer-circumferential surface of the main portion has an annular recessed portion, the annular recessed portion being formed at a position including the upper end of the outer-circumferential surface, the annular recessed portion extending in the circumferential direction of the main portion, the upper knurl projection portions protruding from an inner surface of the annular recessed portion.

4. The closure structure according to claim 3, wherein each of the upper knurl projection portions is formed in a plate shape perpendicular to the circumferential direction.

5. The closure structure according to claim 3, wherein the side knurl includes a plurality of side knurl projection portions formed at intervals in the circumferential direction.

6. The closure structure according to claim 3, wherein the side knurl includes a plurality of side knurl projection portions formed at intervals in the circumferential direction.

7. The closure structure according to claim 6, wherein a height of each of the plurality of side knurl projection portions is 0.3 mm or more, and a width of each of the plurality of side knurl projection portions is from about 0.2 mm to about 1.5 mm.

8. The closure structure according to claim 7, wherein each pitch of the plurality of side knurl projection portions is from 0.5 to 3 mm.

9. The closure structure according to claim 6, wherein a height of each of the plurality of side knurl projection portions is less than 0.5 mm, a width of each of the plurality of side knurl projection portions is from about 0.2 mm to about 1.5 mm.

10. The closure structure according to claim 9, wherein each pitch of the plurality of side knurl projection portions is from 0.5 to 3 mm.

11. The closure structure according to claim 3, wherein a height of each of the plurality of upper knurl projection portions is 0.3 mm or more, and a width of each of the plurality of upper knurl projection portions is 0.1 mm or more.

12. The closure structure according to claim 11, wherein a pitch of the plurality of upper knurl projection portions is from 0.5 to 3 mm.

13. The closure structure according to claim 3, wherein a height of each of the plurality of upper knurl projection portions is 0.8 mm or less, and a width of each of the plurality of upper knurl projection portions is 0.1 mm or less.

14. The closure structure according to claim 13, wherein a pitch of the plurality of upper knurl projection portions is from 0.5 to 3 mm.

* * * * *